US010520191B1

(12) United States Patent
Moon, Jr. et al.

(10) Patent No.: US 10,520,191 B1
(45) Date of Patent: Dec. 31, 2019

(54) APPARATUS AND METHOD FOR REDUCING IGNITOR ACTIVATION TIME IN AN OIL-FIRED BURNER

(71) Applicant: Carlin Combustion Technology, Inc., New Haven, CT (US)

(72) Inventors: Lawrence C. Moon, Jr., Madison, CT (US); Marc R. Bryden, West Springfield, MA (US); James L. Jones, Winfield, KS (US)

(73) Assignee: Carlin Combustion Technology, Inc, North Haven, CT (US)

( * ) Notice: Subject to any disclaimer, the term of this patent is extended or adjusted under 35 U.S.C. 154(b) by 1007 days.

(21) Appl. No.: 14/267,502

(22) Filed: May 1, 2014

Related U.S. Application Data

(60) Provisional application No. 61/818,589, filed on May 2, 2013.

(51) Int. Cl.
*F23N 5/24* (2006.01)
*F23N 5/20* (2006.01)
*F23N 5/26* (2006.01)

(52) U.S. Cl.
CPC ..... *F23N 5/242* (2013.01); *F23N 5/203* (2013.01); *F23N 5/265* (2013.01)

(58) Field of Classification Search
CPC ..... F23N 5/242; F23N 5/203; F23N 5/265
See application file for complete search history.

(56) References Cited

U.S. PATENT DOCUMENTS 1,920,115 A * 7/1933 Spear ..... 315/277
2,372,276 A * 3/1945 Isserstedt ..... F23N 5/20 337/42
2,894,567 A * 7/1959 Bishofberger ..... F23N 5/045 431/29
3,275,058 A * 9/1966 Gage ..... F23N 5/20 431/16
4,167,389 A * 9/1979 Donnelly ..... F23N 5/082 307/117
4,168,949 A * 9/1979 Hamelink ..... F23N 5/123 137/66
4,235,587 A * 11/1980 Miles ..... F23N 5/082 431/68
4,257,759 A * 3/1981 Miles ..... F23N 5/082 431/31
4,925,386 A * 5/1990 Donnelly ..... F23N 5/203 219/260
5,894,988 A * 4/1999 Brenner ..... B60H 1/2206 237/2 A (Continued)

*Primary Examiner* — Edelmira Bosques
*Assistant Examiner* — Logan P Jones
(74) *Attorney, Agent, or Firm* — Delio Peterson & Curcio LLC; Robert Curcio

(57) ABSTRACT

A controller for an oil fired burner for operating the ignitor initially in an interrupted mode, and instructing the burner to switch to intermittent ignition for a plurality of call-for-heat ("CFH") cycles if it is determined that the flame quality is insufficient during the flame-proved period. On the last predetermined iteration cycle, a reset condition occurs; setting a counter back to zero, and a retry ignition is performed to operate once again in interrupted ignition mode. When the apparatus is in interrupted ignition mode, if the current CFH cycle ends normally by satisfying the call, the ignition will remain in the interrupted ignition mode.

5 Claims, 2 Drawing Sheets

(56) References Cited

U.S. PATENT DOCUMENTS

| | | | | |
|---|---|---|---|---|
| 6,478,574 | B1 * | 11/2002 | Melcher | F23N 5/203 431/18 |
| 7,270,098 | B2 * | 9/2007 | Young | B60H 1/2206 123/142.5 R |
| 7,878,795 | B2 * | 2/2011 | Bohan, Jr. | F23N 5/203 126/116 A |
| 2005/0092851 | A1 * | 5/2005 | Troost | F23D 11/36 236/91 B |
| 2008/0216771 | A1 * | 9/2008 | Paine | F23N 1/082 122/14.2 |
| 2010/0079512 | A1 * | 4/2010 | McCracken | B41J 2/17593 347/7 |

* cited by examiner

APPARATUS AND METHOD FOR REDUCING IGNITOR ACTIVATION TIME IN AN OIL-FIRED BURNER

BACKGROUND OF THE INVENTION

1. Field of the Invention

The present invention relates to an ignitor for an oil-fired burner, and more specifically to the monitoring and controlling of an ignitor in its intermittent mode to limit its on-time activation.

2. Description of Related Art

Heating oil in liquid form must be turned into vapor and mixed with air before it can burn. Generally, in an oil-fired burner, an oil pump lifts the oil from a storage tank, pressurizes it and delivers it to the burner's nozzle that sprays the oil in a fine mist of small droplets. This process is commonly referred to as atomizing. The droplets are mixed with air and then ignited by a spark from the burner's ignition system.

The flame from the oil burner heats the air in a heat exchanger inside the boiler or furnace. On one side of the metal structure is the flame, and on the other is the water or air that circulates in the space to be heated. All of the emissions from the oil flame (mostly nitrogen, water, and carbon dioxide) are sent out an exhaust, such as a chimney. High pressure oil burners depend on a high voltage electric spark to supply the heat required to start the combustion process. As the air-oil mixture leaves the burner, the spark vaporizes and ignites a very small portion of the mixture. This initial flame is hot enough to ignite the rest of the mixture.

Some oil burners use glow bars for ignition, which operate much like the glow plugs of a diesel engine. Most burners, however, use high voltage generated by a voltage-step up transformer and a spark plug to initiate ignition.

Generally, an ignition system has four parts: 1) the ignition transformer or electronic sparking device that provides the high voltage (10,000- to 14,000-volt) spark; 2) the electrodes that deliver the spark at the exact point required for smooth light off; 3) high tension wires, bus bars, or springs that transport the high voltage electricity from the transformer to the electrodes; and 4) the electrode bracket that keeps the electrodes in the proper position for smooth light off. (On many older burners the stabilizer was used as the electrode bracket.) The ignition transformer is usually a step up transformer, increasing the voltage from 120 volts to a high voltage on the order of 10,000 volts.

Electronic ignitors are generally solid state units. In most designs, a 120-volt AC current is internally converted to DC. The DC voltage then turns power transistors on and off very quickly, sending current through the primary coil of a small internal transformer at a frequency of 15,000 to 30,000 Hz. A secondary coil of the special high frequency transformer produces the high voltage ignitor output that also has a frequency in the range of 15,000 to 30,000 Hz. The high frequency allows the voltage to peak at the output voltage of 14,000 volts. This high voltage current supplies an intense, active spark at the electrode tips.

An electronic ignitor can be used as a direct replacement for an ignition transformer.

In an intermittent system, the igniter is energized whenever the motor is running, which delivers constant ignition spark at the electrode tips. In an interrupted system, the ignition is on for a short period of time (only during the try-for-ignition period) and then, once the flame is established, the spark is shut off. In an intermittent system the ignitor is on when the fan motor is on, and may be on for a long time, for as many hours as it takes to satisfy the heat call.

The present invention addresses the issue of an oil primary control operating with an ignitor in intermittent mode, that is, the ignitor is on when the fan motor is on, in which the ignitor may be active for long periods of time. This causes the ignitor to operate at its maximum operating temperature, which can shorten the ignitor's operational life. The present invention through the implementation of intermittent operation extends the life of the electrodes, and promotes energy efficiency.

SUMMARY OF THE INVENTION

Bearing in mind the problems and deficiencies of the prior art, it is therefore an object of the present invention to provide a method for controlling a burner ignition system comprising initially operating the burner in an interrupted ignition mode during a call for heat, and switching to an intermittent ignition mode for a plurality of call-for-heat cycles if flame quality is confirmed insufficient when monitoring said flame during a flame proven state.

The above and other objects, which will be apparent to those skilled in the art, are achieved in the present invention which is directed to in a first aspect a method for controlling a burner ignition system comprising initially operating the burner in an interrupted ignition mode during a call for heat, and switching to an intermittent ignition mode for a plurality of call-for-heat cycles if during a flame proven mode, a flame is determined to be insufficient or confirmed lost. The method includes reverting back to the interrupted ignition mode when a count of the plurality of call-for-heat cycles reaches a predetermined limit.

The method further includes resetting a call-for-heat iteration loop cycle count back to zero when a count of the plurality of call-for-heat cycles reaches a predetermined limit, and operating the ignition system in the interrupted ignition mode.

The ignition system remains in interrupted ignition mode if a current call-for-heat cycle exits due to lost power, lost T-T, or lost limit condition.

The flame is determined to be insufficient if an average reading of a CAD cell resistance measurements over a first time period is greater than a running average of CAD cell resistance measurements over a second time period, the second time period shorter than the first time period.

In a second aspect, the present invention is directed to a method for controlling a burner ignition system comprising performing the following control logic steps:

a. at power on, setting an intermittent ignition iteration loop counter to zero if the power on is an initial power on, or retrieving a saved count from nonvolatile memory for subsequent power on;
b. receiving and determining a status for a call-for-heat signal;
c. if the call-for-heat signal status is affirmed, measuring at least one system parameter for analytically assessing flame quality;
d. determining if a try-for-ignition status is complete;
e. if the try-for-ignition status is not complete, reverting the ignition system back to step (b), receiving and determining a status for a call-for-heat signal;

f. if the try-for-ignition status is complete, checking the intermittent ignition iteration loop cycle counter;

g. if the intermittent ignition iteration loop cycle counter is zero, activating the ignition system Flame Proven mode, else if the intermittent ignition iteration loop cycle counter is not zero, incrementing the iteration loop cycle counter, and comparing the iteration loop cycle counter to a predetermined count limit;

h. if the iteration loop cycle counter in step (g) is at the predetermined count limit, setting the iteration loop cycle counter to zero and setting a nonvolatile counter to the loop counter, else, if the loop counter in step (g) is not at the predetermined limit and is not zero, setting the nonvolatile counter to the loop counter, and activating the ignition system Flame Prove mode;

i. if the status for a call-for-heat signal in the step (b) is not affirmed, activate a test reset mode including:

1. determining if T-T is open, and if the T-T is open, determining if a reset condition has been activated;
2. if the reset condition of the step (i)(1) has been activated, turning on a user visual indicator, setting the iteration loop cycle counter and the nonvolatile counter to zero, and returning the ignition system to the step (b);
3. if the reset condition of the step (i)(1) is not activated, the user visual indicator is turned off, and the ignition system is returned to the step (b);
4. if the T-T is not open in the step (i)(1), returning the ignition system to the step (b);

j. if the ignition system has reached the Flame Proven mode, performing the method steps including:

1. if the iteration loop cycle counter is zero, measuring at least one system parameter for analytically assessing flame quality;
2. if the flame quality of the step (j)(1) is insufficient, adjusting the iteration loop cycle counter to "1", and setting the nonvolatile counter to "1";
3. adjusting the ignition system to interrupted ignition mode if the iteration loop cycle counter is zero, else maintaining the ignition system in intermittent ignition mode;
4. if the flame quality measured in the step (j)(1) is sufficient, adjusting the ignition system to interrupt ignition mode if the iteration loop cycle counter is zero, else maintaining the ignition system in intermittent ignition mode, without performing the step (j)(2);
5. determining if the call-for-heat has ceased, and returning to the Flame Proven mode of the step (j) if the call-for-heat has not ceased, else determining an exit status for the call-for-heat;

k. reverting the ignition system to waiting for a next call-for-heat signal if the call-for-heat exited due lost T-T or lost limit has been reached;

l. if the call-for-heat exited due to a lost flame condition, entering a recycle mode and setting the iteration loop cycle counter and the nonvolatile counter to "1" and then when the recycle mode ends, waiting for a next call-for-heat signal; and m. if the call-for-heat exited due to lost power, powering down the ignition system.

Step (c) includes assessing the flame quality by determining an average reading of a CAD cell resistance measurement over a first sample time period and a running average of the CAD cell resistance measurements over a second sample time period, the second sample time period shorter than the first sample time period, and comparing the CAD cell resistance values.

The method further includes changing the ignition system to intermittent ignition mode if the comparison of the CAD cell resistance values is greater than a predetermined value.

In a third aspect, the present invention is directed to a burner ignition system comprising: an air-oil mixture nozzle; electrode tips; and a central processing unit implementing a program readable by a machine, tangibly embodying a program of instructions executable by the machine to perform method steps for controlling the burner, the method steps comprising: a) initially operating the burner in an interrupted ignition mode during a call for heat; and b) switching to an intermittent ignition mode for a plurality of call-for-heat cycles if during a flame proven mode, a flame is determined to be insufficient or confirmed lost.

In a fourth aspect, the present invention is directed to a burner ignition system comprising: an air-oil mixture nozzle; electrode tips; and a central processing unit implementing a program readable by a machine, tangibly embodying a program of instructions executable by the machine to perform method steps for controlling the burner, the method steps comprising those identified in the second aspect of the invention above.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIG. 1 of the drawings in which like numerals refer to like features of the invention.

It has been shown that in most applications, where intermittent ignition is used in lieu of interrupted ignition, the interrupted mode would have worked well under most circumstances. An ignitor in intermittent mode will activate along with the fan motor. However, this puts the ignitor in a situation where it remains on for long periods of time during a call for heat, causing the ignitor to operate at its maximum temperature and shortening its life. In a preferred embodiment, the present invention introduces operating the ignitor initially in interrupted mode. If the flame quality is not shown to be measurably sufficient when compared to predetermined quality factors during the Flame-Proven period, the apparatus is instructed to switch to intermittent ignition mode for the next call-for-heat ("CFH") cycle or for a plurality of call-for-heat cycles, for example "n" cycles, where n is a constant predetermined limit. On the last or nth cycle, a reset condition is activated, which sets an iteration loop cycle counter back to zero, and a retry ignition step is performed to operate the system once again in interrupted ignition mode. When the apparatus is in interrupted ignition mode, if the current CFH cycle ends normally by satisfying the call-for-heat and not exiting through the "recycle" state, the ignition will remain in the interrupted ignition mode.

During the Flame-Proven state, the CAD cell resistance is monitored to assess analytically potential flame loss. A CAD cell is a light-sensitive cell that changes its resistance in the presence of light. In most cases, the resistance decreases as the cell views the light. The CAD cell is used to detect the ignition of the oil burner. In this manner, the quality of the flame is assessed, rather than simply a flame-on or flame-out status, and the system operation alters depending upon the measured flame integrity. As an illustrative example, if at any time during the Flame Proven state, the short term resistance (received in the last ¼ second) exceeds a 5 second running average by a predetermined offset resistance value, the ignition mode would be changed to intermittent ignition for the remainder of the CFH cycle currently engaged, and for the next m cycle, where m is a predetermined constant limit. This is neither a flame-on or flame-out condition; rather, it reflects and makes an assessment on the existing quality of the flame at the time of measurement.

Figure 1A:
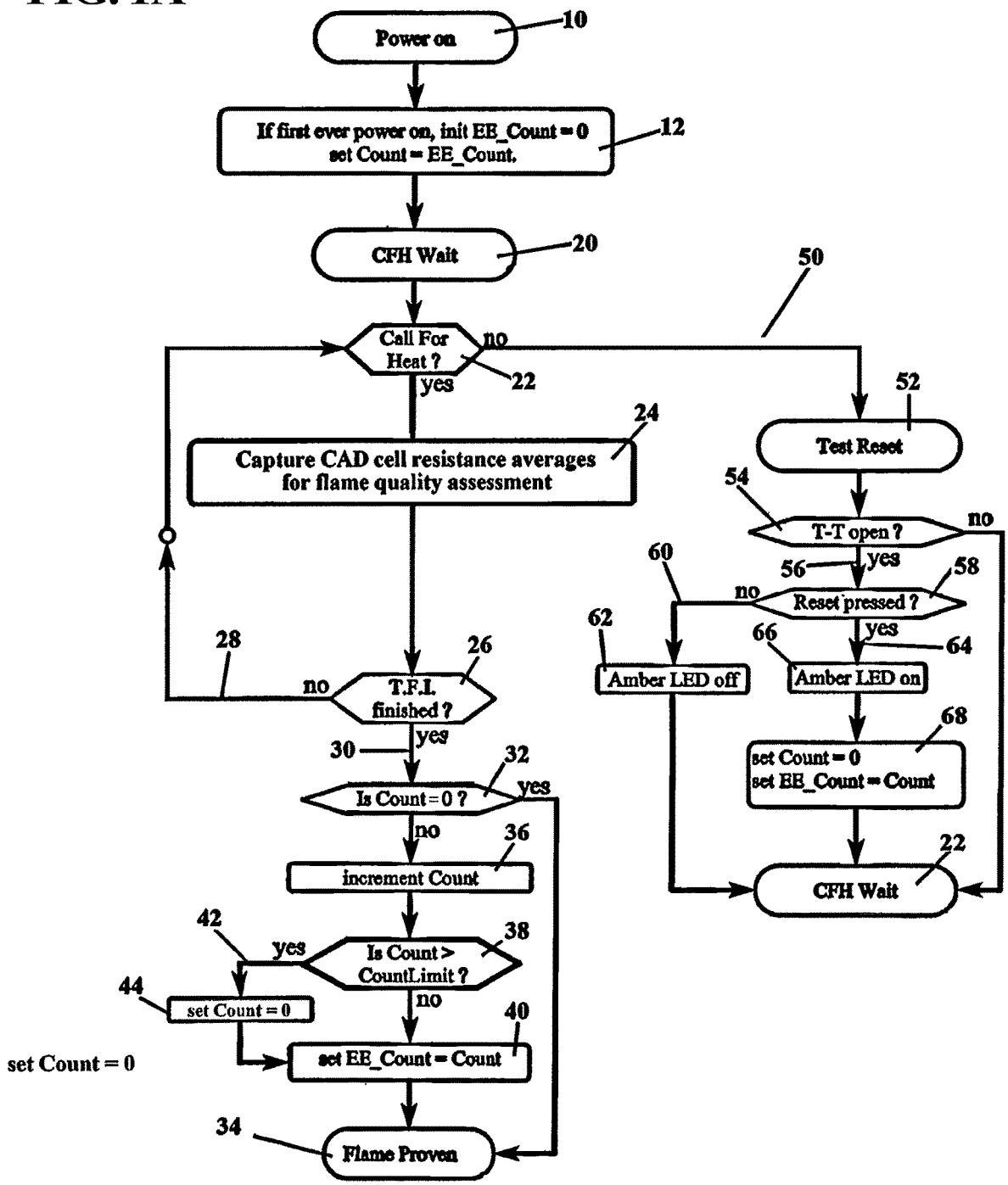
FIG. 1A depicts a logic flow chart of an algorithm of a preferred embodiment of the present invention from the Power On initiation to the Flame Proven mode.

FIG. 1A depicts a logic flow chart of an algorithm of a preferred embodiment of the present invention from the Power On initiation to the Flame Proven mode, for addressing and mitigating an undesirably long time period in which an ignitor may be on during a call for heat.

In a first step at initial power on (step 10), an iteration loop cycle count is set to a nonvolatile value of the count, which is initially set to zero (step 12). A call-for-heat signal is then monitored (step 20). If there is a call-for-heat (CFH) signal, a first action is required (step 22). In order to analytically assess the flame quality at interim intervals, the CAD cell resistance is periodically measured (step 24). CAD cell resistances are captured and continuously averaged. In one embodiment, the CAD cell resistance measurements are taken (update) at 50 millisecond intervals, and a running 5 second average is calculated. Upon further inquiry, a quarter-second CAD cell resistance running average is generated with the same sampled data, referred to as the short-term resistance, is also taken, which is ultimately compared to the five second running average for a later assessment of flame quality. This is a measured assessment of flame loss predictability. In this manner, system action may still be required even if the flame is "on", since the flame may be of questionable quality.

The system then determines if a try-for-ignition (TFI) period is complete (step 26). The TFI period is complete when flame stabilization is complete. If the TFI period is not complete 28, the algorithm reverts back step 22 to determine if there still is a CFH signal. If the TFI period is complete 30, the iteration loop cycle count is checked to see if this is the first time through this iteration loop (step 32), that is, if the iteration loop cycle count is still zero.

If it is the first time through this iteration loop, the cycle count would still be zero, and the system is directed to assess the flame in the Flame Proven mode (step 34). If it is not the first time through the iteration loop (the iteration loop cycle count does not equal zero), the iteration loop cycle count is incremented (step 36), and compared to a predetermined limit to assess if it has exceeded the predetermined limit (step 38). If the iteration loop cycle count has not exceed the predetermined limit, the nonvolatile value of the count is set equal to the loop cycle count value (step 40), and the system is directed to assess the flame in the Flame Proven mode (step 34). If the iteration loop count exceeds the predetermined limit 42, the iteration loop cycle count is set to zero (step 44), and the nonvolatile value of the count is set equal to the loop cycle count (step 40). Although the predetermined limit may be any value set for continuous operation of the ignition system, preferably, the predetermined limit is in the range of n=2 to 250, and more preferably, the predetermined limit is in the range of n=5 to 50. In one embodiment, the predetermined limit for the iteration loop counter was set at 10.

If, at an interim power on, which is not the initial power on (step 10), there is no call for heat 50, or if upon exit from a prior call-for-heat there is no new call-for-heat, the ignition system is effectively in standby mode. While in standby mode, the system tests to determine if the reset button has been activated which would reset the iteration loop cycle count (step 52). The system determines if the room temperature control thermostat input (T-T) is open (step 54). If the T-T is not open, the system reverts to waiting for a call-for-heat (step 22). If the T-T is open 56, the system determines if a reset condition has been activated (step 58).

If the reset has not been activated 60, a visual indicator 62 is removed. Preferably, the visual indicator is a light indicator, but other visual indicators are not precluded. The ignition system then reverts back to waiting for the next call-for-heat (step 22).

If the reset has been activated 64, the user is notified by the visual indicator (step 66), preferably a light indicator. The iteration loop cycle count is set to zero, and the nonvolatile value of the cycle count is set equal to the iteration loop cycle count (step 68). The ignition system then reverts back to waiting for the next call-for-heat (step 22).

Figure 1B:
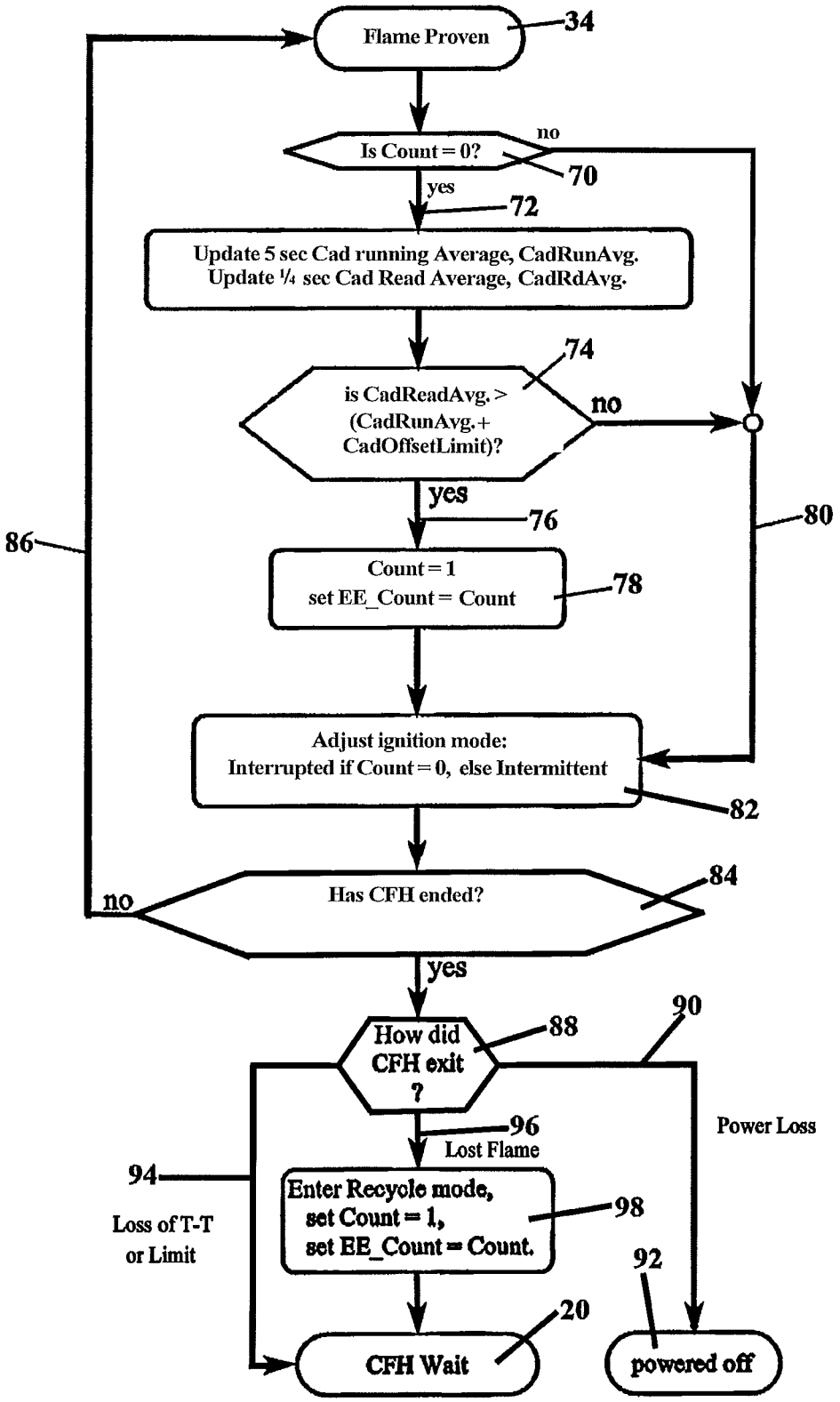
FIG. 1B depicts a logic flow chart of an algorithm of a preferred embodiment of the present invention of the ignition system method steps occurring after the Flame Proven stage.

FIG. 1B depicts a logic flow chart of an algorithm of a preferred embodiment of the present invention of the ignition system method steps occurring after the Flame Proven stage. Referring to FIG. 1B, at the Flame Proven stage (step 34), the ignition system checks if the iteration loop cycle count is at zero (step 70). If the iteration loop cycle count is not zero, this means the ignition control is currently in intermittent ignition mode. Consequently, there is no need to monitor the CAD cell resistance for flame quality or flame loss predictability. If the iteration loop cycle count is zero (step 72), the CAD cell resistance is captured for different time intervals (step 74) for two separate calculations: a running average for a first time period; and a second average over a second time period shorter than the first time period. The first calculation is considered a CAD cell resistance "running average", while the second calculation is considered a CAD cell resistance "read". If the "read" average is greater than the "running average" by a predetermined offset limit 76, the iteration loop cycle count is set to "1" and the nonvolatile value of the count is set to the count, i.e., set to "1" (step 78). If the "read" average is less than or equal to the "running average" 80, the iteration loop cycle count remains at "0". The running average 80 may include an offset value.

Depending upon the value of the iteration loop cycle count, the ignition mode is adjusted accordingly, such that the ignition mode is in interrupt ignition if the iteration loop cycle count is "0" and in intermittent ignition mode if the iteration loop cycle count is some other count value (step 82). The ignition system next checks to determine if the current call-for-heat has ended (step 84). If the current call-for-heat has not ended, the Flame Proven cycle repeats 86 starting at step 34; else, the nature of how the call-for-heat exited is determined (step 88). If, when proceeding to the exit mode, the resultant activity was determined to be due to "lost power" 90, the ignition system is powered off (step 92). Power can be lost because either the service switch was open or if control power is governed by a limit string and the limit has been reached. Power loss is not considered an abnormal call-for-heat exit.

If, when proceeding to the exit mode, the resultant activity was determined to be due to lost "T-T" or reached a boiler condition limit 94, such as for example boiler temperature, exhaust stack pressure, and furnace heat exchanger temperature, to name a few, the ignition system reverts back to waiting for the next call-for-heat (step 20). Limit signals are normally-closed contacts that open when a limit condition is reached. If, when proceeding to the exit mode, the resultant activity was determined to be due to a "lost flame" condition 96, the ignition system algorithm enters a recycle mode, which turns off the valve, motor and igniter, and sets the iteration loop cycle count to one, and the nonvolatile value of the cycle count to the cycle count, i.e., "1" (step 98). After a predetermined period of time, the ignition system then reverts back to waiting for the next call-for-heat (step 20).

The preferred embodiment described above represents an algorithm that allows the ignition system of an oil-fired burner to operate initially in interrupted ignition mode, and switch to intermittent ignition mode in lieu of an interrupted ignition mode if and when the quality of the flame is measurably insufficient, in which case a flame loss is predictable and anticipated, or the flame is completely lost, and remain in intermittent ignition mode for a predetermined number of call-for-heat cycles. Once the predetermined limit for call-for-heat cycles in intermittent ignition mode is reached, the ignition system is set back to interrupted ignition mode.

Modifications to the algorithm may be made while maintaining the salient features of the present invention to operate a burner initially in the interrupted mode, and switch to an intermittent mode if flame quality is determined to be insufficient during the Flame Proven period. The intermittent mode is used on a cycled basis until a call-for-heat is satisfied or a cycle count reaches a predetermined limit.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for controlling a burner ignition system comprising:

initially operating said burner in an interrupted ignition mode during a call for heat;

switching to an intermittent ignition mode for a plurality of call-for-heat cycles if during a flame proven mode, a flame is determined to be insufficient or confirmed lost; and reverting back to said interrupted ignition mode when a count of said plurality of call-for-heat cycles reaches a predetermined limit.

2. The method of claim 1 including resetting a call-for-heat iteration loop cycle count back to zero when a count of said plurality of call-for-heat cycles reaches a predetermined limit, and operating said ignition system in said interrupted ignition mode.

3. The method of claim 1 including having said ignition system remain in interrupted ignition mode if a current call-for-heat cycle exits due to lost power, lost T-T, or lost limit condition.

4. The method of claim 1 wherein said flame is determined to be insufficient if an average reading of a CAD cell resistance measurements over a first time period is greater than a running average of CAD cell resistance measurements over a second time period, said second time period shorter than said first time period.

5. A burner ignition system comprising:

an air-oil mixture nozzle;

electrode tips;

and a central processing unit implementing a program readable by a machine, tangibly embodying a program of instructions executable by the machine to perform method steps for controlling said burner, said method steps comprising:

a) initially operating said burner in an interrupted ignition mode during a call for heat;

b) switching to an intermittent ignition mode for a plurality of call-for-heat cycles if during a flame proven mode, a flame is determined to be insufficient or confirmed lost;

c) reverting back to said interrupted ignition mode when a count of said plurality of call-for-heat cycles reaches a predetermined limit; and d) having said ignition system remain in interrupted ignition mode if a current call-for-heat cycle exits due to lost power, lost T-T, or lost limit condition.

* * * * *